US007063158B2

(12) United States Patent
Horton, III

(10) Patent No.: US 7,063,158 B2
(45) Date of Patent: Jun. 20, 2006

(54) BOTTOM TENSIONED OFFSHORE OIL WELL PRODUCTION RISER

(75) Inventor: Edward E. Horton, III, Houston, TX (US)

(73) Assignee: Deepwater Technologies, Inc., Houston, TX (US)

( * ) Notice: Subject to any disclaimer, the term of this patent is extended or adjusted under 35 U.S.C. 154(b) by 102 days.

(21) Appl. No.: 10/626,488

(22) Filed: Jul. 24, 2003

(65) Prior Publication Data

US 2004/0251029 A1 Dec. 16, 2004

Related U.S. Application Data

(60) Provisional application No. 60/478,880, filed on Jun. 16, 2003.

(51) Int. Cl.
*E21B 29/12* (2006.01)
*E21B 7/12* (2006.01)

(52) U.S. Cl. ..... 166/355; 166/352; 405/224.4

(58) Field of Classification Search ..... 166/354, 166/355, 352, 350, 368, 365; 405/224.2, 405/224, 224.4, 227, 202, 172, 171
See application file for complete search history.

(56) References Cited

U.S. PATENT DOCUMENTS 3,602,174 A 8/1971 Gorman
4,088,089 A * 5/1978 Flory ..... 114/230.14
4,265,313 A * 5/1981 Arnaudeau ..... 166/366
4,310,937 A * 1/1982 Karl et al. ..... 441/5
4,436,451 A * 3/1984 Anderson ..... 405/224.2
4,462,717 A 7/1984 Falcimaigne
4,519,726 A * 5/1985 Knowles et al. ..... 405/195.1
4,529,334 A * 7/1985 Ortloff ..... 405/224.2
4,567,843 A * 2/1986 d'Hautefeuille ..... 114/230.14
4,637,335 A * 1/1987 Pollack ..... 114/230.12
4,645,467 A * 2/1987 Pollack ..... 441/4

(Continued)

FOREIGN PATENT DOCUMENTS

GB 2084537 4/1982

OTHER PUBLICATIONS

Remery, J. & Coutarel, A.: "The Hybrid Catenary Riser: A New and Optimised Riser Configuration for Ultra Deep Water" Dot, Nov. 2000.

*Primary Examiner*—Thomas A Beach
(74) *Attorney, Agent, or Firm*—Klein, O'Neill & Singh, LLP; Howard J. Klein

(57) ABSTRACT

An offshore oil well riser system comprises one or more tubular conduits suspended from a floating platform and having bottom ends extending downward substantially vertically toward the sea floor. A bottom end connection and tensioning assembly is disposed at the bottom ends of the conduits and comprises a jumper for connecting the bottom end of each conduit to an associated sub-sea oil well, a weight for applying a vertical tension in the conduits, and an apparatus for constraining the bottom end of the conduits against horizontal movement, while enabling them to move freely in a vertical direction and to pivot freely at their bottom ends in response to motions of the platform on the water surface. The riser system is useful with a wide variety of floating platforms, and can be employed in either dry tree or wet tree completion systems.

15 Claims, 7 Drawing Sheets

U.S. PATENT DOCUMENTS 4,693,316 A * 9/1987 Ringgenberg et al. ..... 166/355
4,702,321 A 10/1987 Horton
4,721,412 A * 1/1988 King et al. ..... 405/195.1
5,275,510 A * 1/1994 de Baan et al. ..... 405/171
5,794,700 A * 8/1998 Pollack ..... 166/339
6,082,391 A 7/2000 Thiebaud et al.
6,109,830 A 8/2000 De Baan
6,431,284 B1 8/2002 Finn et al.
2002/0060077 A1 5/2002 Biolley
2002/0177375 A1 11/2002 Cottrell et al.
2004/0031614 A1 2/2004 Kleinhans

* cited by examiner

BOTTOM TENSIONED OFFSHORE OIL WELL PRODUCTION RISER

CROSS-REFERENCE TO RELATED APPLICATIONS

This Application claims benefit of U.S. Provisional Patent Application Ser. No. 60/478,880, filed Jun. 16, 2003.

STATEMENT REGARDING FEDERALLY SPONSORED RESEARCH OR DEVELOPMENT (Not Applicable)

REFERENCE TO APPENDIX (Not Applicable)

BACKGROUND OF THE INVENTION

1. Field of the Invention

This invention relates, in general, to offshore oil well risers that convey petroleum from producing wells on the sea floor to a floating platform on the sea surface, and in particular, to risers that are tensioned at their bottom ends to enable them to accommodate large motions of the platform relative to the wells without sustaining damage.

2. Description of Related Art

Conventional "dry tree" offshore floating petroleum production platforms include such "low heave" platforms as Spars, Tension Leg Platforms ("TLPs"), and Deep Draft semi submersible platforms. These platforms are capable of supporting a plurality of vertical production and/or drilling risers. These platforms typically comprise a well deck, where the surface, or dry, trees, which are mounted on top of the risers, are located, and a production deck where crude oil from one or more sub-sea wells is collected in a manifold and conveyed to a processing facility to separate the oil from entrained water and gas. In conventional dry tree offshore platforms, each of the vertical risers extending from the well heads to the well deck are supported thereon by a tensioning apparatus, and hence, are referred to as Top Tensioned Risers ("TTRs").

One type of conventional TTR system uses active hydraulic tensioners connected to the well deck of the offshore platform to support each riser independently of the others. See, e.g., U.S. Pat. No. 6,431,284 to L. D. Finn et al, and FIG. 1 of the appended drawings. Each riser 100 extends vertically from a well head 102 on the sea floor to a well deck 104 of the platform, and is supported thereon by hydraulic cylinders 106, such that the platform can move up and down relative to the risers and thereby partially isolate the risers from the heave motions of the platform. A surface tree 108 is connected on top of the riser, and a high pressure, flexible jumper 110, typically incorporating an elastomer, connects the surface tree to the production deck 112. However, as tension and stroke requirements of the active tensioners increases, they become prohibitively expensive to deploy. Furthermore, the offshore platform must be capable of supporting the entire load of the risers, which can be substantial.

Another known TTR system (see, e.g., U.S. Pat. No. 4,702,321 to E. E. Horton and FIG. 2 hereof) uses passive "buoyancy cans" 202 to support a riser 204 independently of the floating platform. In this system, each riser extends up vertically from a well head 206 through the keel of the platform and to the well deck 208 of the platform, where it connects to a "stem" pipe 210, to which the buoyancy cans are attached. The stem extends above the buoyancy cans and supports the work platform to which the riser and its associated surface tree are attached. A high pressure, flexible jumper 212 connects the surface tree 214 to the production deck 216. As the risers are independently supported by the buoyancy cans relative to the platform's hull, the hull can move up and down relative to the risers, and the risers are thereby isolated from the heave motions of the platform. However, the buoyancy cans must provide sufficient buoyancy to provide the required top tension in the risers, and to support the weight of the can, the stem and the surface tree. In deeper waters, the buoyancy required to provide this support is substantially greater, requiring larger buoyancy cans. Consequently, the deck space required to accommodate all the risers also increases. Manufacturing and deploying individual buoyancy cans for each riser is also costly.

In both of the above TTR systems, the tension applied to the riser must be sufficient not only to support the weight of the riser system, but also to ensure that the riser does not go slack or vibrate in response to current vortices. In general, the required top tension will be in the range of from about 1.4 to 1.6 times the weight of the riser system. This requirement dramatically increases the cost of the tensioning system, and in some deepwater applications, where the weight of the riser is substantially greater, can result in an overstress of the risers.

A third type of dry tree riser system comprises the so-called "riser tower," such as that described in U.S. Pat. No. 6,082,391 to F. Thiebaud et al and illustrated in FIG. 3. In this system, the riser tower includes one or more rigid vertical pipes 302 connected to the seafloor through a pivot connection or a stress joint 304. The pipes are supported by a large top buoyancy device 306, which provides sufficient buoyancy to support the pipes and prevent them from going slack or vibrating in response to sea currents. Flexible jumpers 308 are used to connect the vertical pipes to a floating support 310. This type of riser system is both expensive and difficult to deploy.

Conventional "wet tree" offshore platforms include Floating Production Storage and Off-loading ("FPSO") and semi submersible platforms, both of which have relatively greater heave responses. The relatively larger motions experienced by these types of platforms make the support of vertical drilling and production risers impractical. These types of platforms are generally used in connection with a sub-sea "completion system," i.e., sub-sea trees which are connected to wells arranged on the seafloor. Produced crude oil may be carried along the seafloor with "flow lines" and collected in a manifold. Production risers convey the crude oil from the manifold or sub-sea trees to the process equipment of the floating support platform. As the support platform experiences relatively large motions, both heave and horizontal, the production risers must be designed to withstand these greater motions.

Wet tree riser systems can comprise flexible, e.g., elastomeric, risers. As shown in FIG. 4, flexible risers 402 are directly connected to a floating platform 404 and present a catenary shape from the floating support down to the sea floor, such as those shown connected to the FPSO platform 404 illustrated in FIG. 4. They are able to accommodate relatively large platform motions due to their flexibility. However they are both heavy and expensive. Alternatively, the risers can comprise so-called Steel Catenary Risers ("SCRs"). Steel Catenary risers are made primarily of steel and connect directly to the floating support by means of a flexible joint or similar arrangement, and like the flexible risers, present a catenary shape when deployed. Additionally, since they are made of steel, SCRs are less expensive. However, due to their greater stiffness, they are prone to fatigue problem resulting from the dynamic motions that they must undergo, and may require relatively greater lengths to accommodate the motions of the platform satisfactorily.

In the above prior art riser systems, the risers are either vertical and supported by a tensioning system independent of the floating platform, wherein a flexible jumper is used at the top of the vertical riser to absorb the relative motion between the vertical riser and the floating platform, or they are supported directly by the floating platform and present a catenary shape requiring a relatively longer length of pipe to absorb the motions of the floating platform. Thus, in the former types of systems, the platform motions are absorbed by the upper part of the riser, and therefore require a critical degree of top tension to prevent a destructive compression of the risers and the occurrence of riser collisions, and in the latter types of the systems, the risers must sag to absorb motions, and therefore require substantially great lengths of pipe to function.

In light of the foregoing drawbacks of the prior art riser systems, a long felt but as yet unsatisfied need exists in the petroleum industry for a simple, low-cost, yet safe and reliable off-shore oil well riser system that compensates for the motions of an associated floating platform.

BRIEF SUMMARY OF THE INVENTION

In accordance with the present invention, an offshore oil well riser system is provided that efficiently compensates for the motions of an associated floating drilling or production platform. The riser system is relatively inexpensive, simple to fabricate and deploy, and reliable in operation.

In one exemplary embodiment thereof, the novel riser system comprises a tubular conduit suspended from a floating platform and having a bottom end extending downward substantially vertically toward the sea floor, and a bottom end connection and tensioning assembly attached to the bottom end of the conduit. The connection and tensioning assembly comprises a jumper for connecting the bottom end of the conduit to a sub-sea oil well, a weight for tensioning the conduit vertically, and means for constraining the bottom end of the conduit against horizontal movement, while enabling it to move freely in a vertical direction and to pivot freely at its bottom end in response to motions of the platform on the water surface.

This riser system is primarily applicable to low heave floating platforms, such as SPARs, TLPs, Deep Draft semi submersibles, and to other platforms used in relatively calm waters, e.g., west of Africa and Brazil. The novel riser system can be used in either dry tree or wet tree completion systems, and the use of a low heave floater minimizes the maximum "stroke," or vertical movement, required of the bottom end connection and tensioning assembly.

The conduit can comprise a single riser pipe, or a bundle thereof, each connected to a respective well through an associated jumper. The bundle of riser pipes may comprise a large, outer casing in which a plurality individual tubular risers are arranged. The annular space of the large casing can be used for facilitating the flow of petroleum through the riser system, e.g., to insulate the individual risers against cold sub-sea ambient temperatures, or alternatively, to heat the risers actively, such as by the injection of steam or hot water into the annular space. The outer casing can also provide a "double-hull" redundancy in case of a breach in one of the risers.

The jumper may comprise a flexible pipe, a plurality of interconnected recurvate pipe sections, a conventional rigid, or "elbow" jumper, or can be articulated with a conventional "flex joint" type of jumper. The jumpers are arranged to absorb substantially all of the motions of the floating platform.

One advantageous feature of the present invention is that, while the conduit is free to move vertically to accommodate the vertical motions of the floating support platform, horizontal movement of the bottom end of the conduit is substantially constrained. This eliminates the type of movement of the bottom end of the riser that leads to high fatigue stresses in the associated jumpers. Another feature of the invention is that the bottom end of the conduit is pivotally connected to the constraining assembly e.g., with a universal joint, a pinned joint, a stress joint, or the like, which enables the riser system to pivot freely relative to its bottom end and thereby accommodate horizontal motions of the floating support while eliminating harmful bending stresses in the conduit.

A better understanding of the above and many other features and advantages of the present invention may be obtained from a consideration of the detailed description thereof below, especially if such consideration is made in conjunction with the views of the appended drawings.

DETAILED DESCRIPTION OF THE INVENTION

Figure 1:
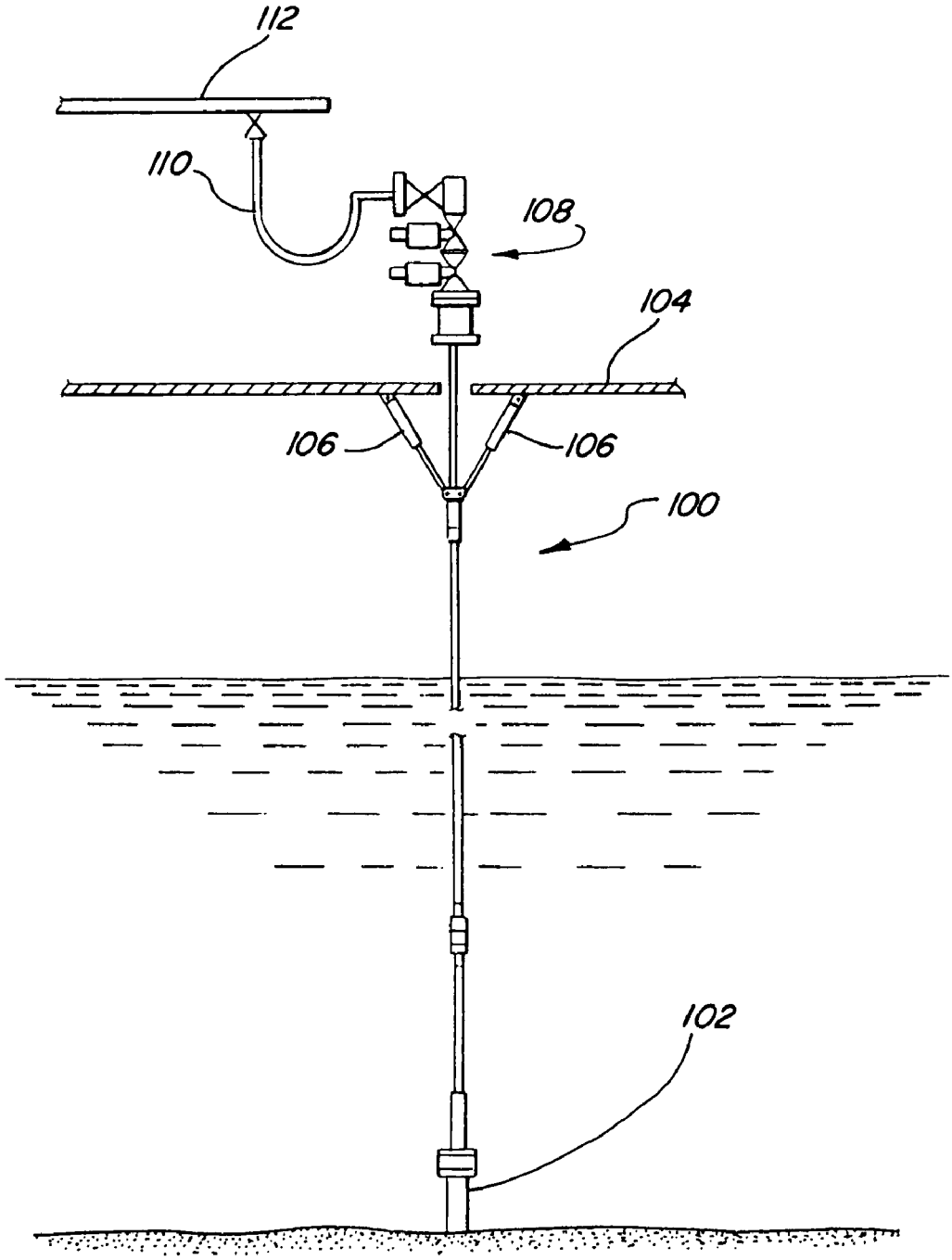
FIG. 1 PRIOR ART
FIG. 1 is an elevation view of a top tensioned dry tree offshore oil well riser system employing active hydraulic riser tensioners in accordance with the prior art.
Figure 2:
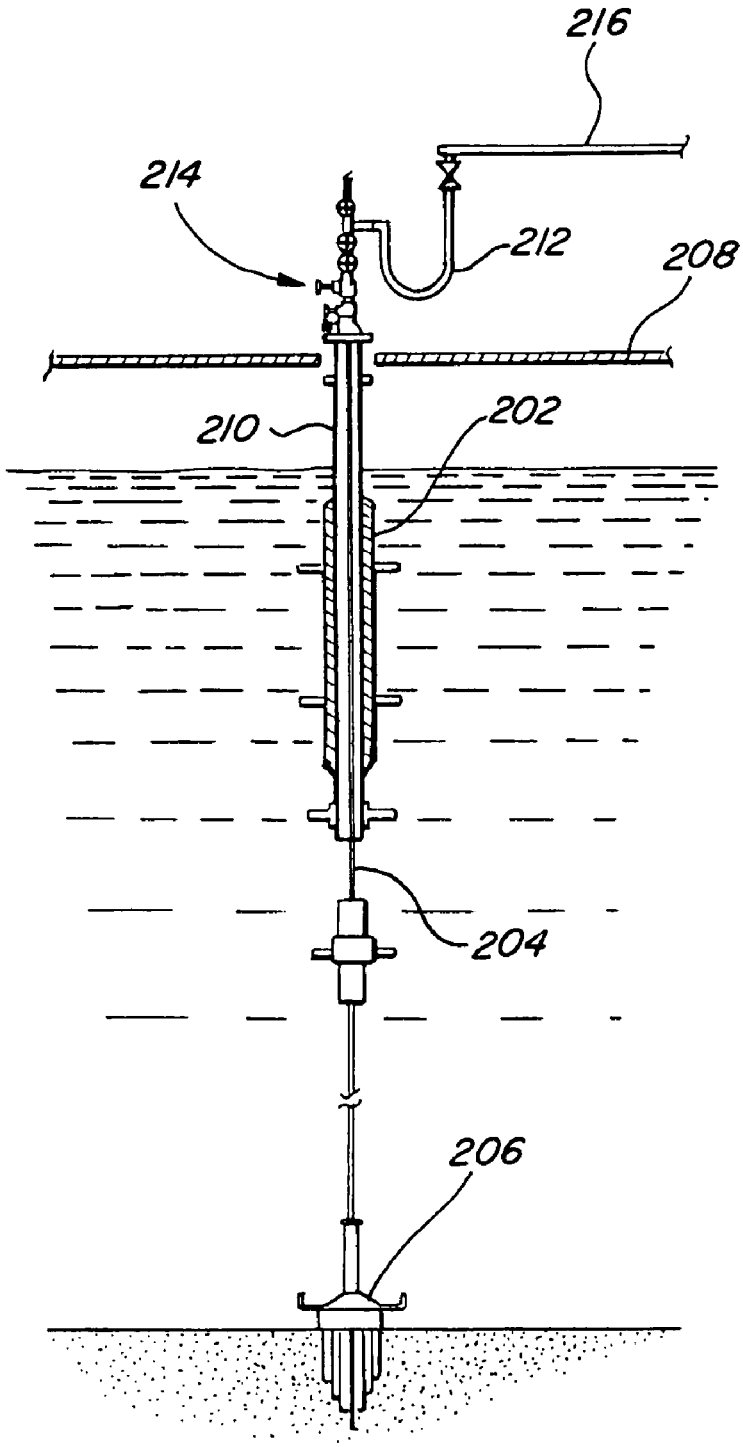
FIG. 2 PRIOR ART
FIG. 2 is an elevation view of a top tensioned dry tree riser system employing passive buoyancy cans in accordance with the prior art.
Figure 3:
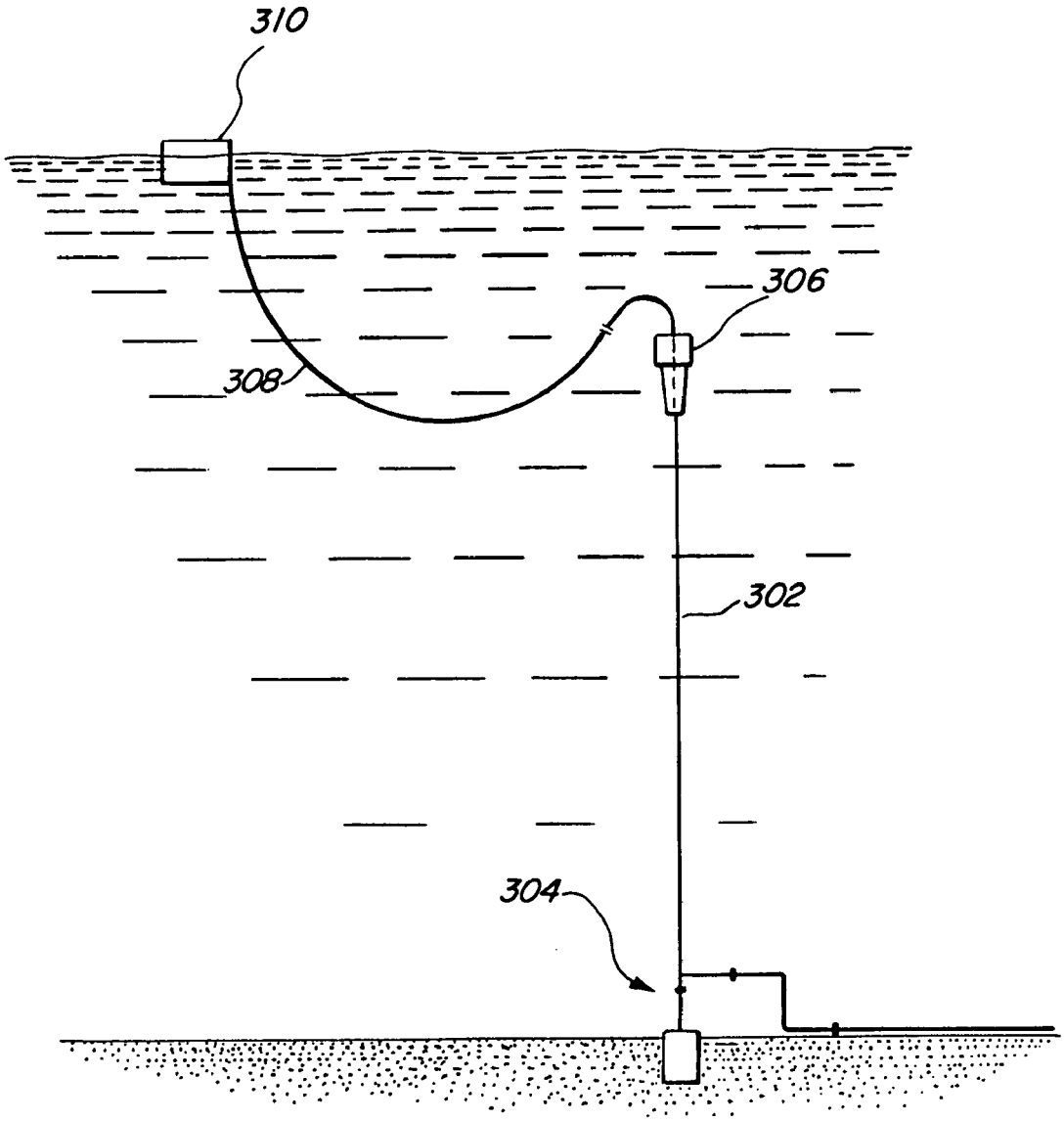
FIG. 3 PRIOR ART
FIG. 3 is an elevation view of a tower type wet tree riser system in accordance with the prior art.
Figure 4:
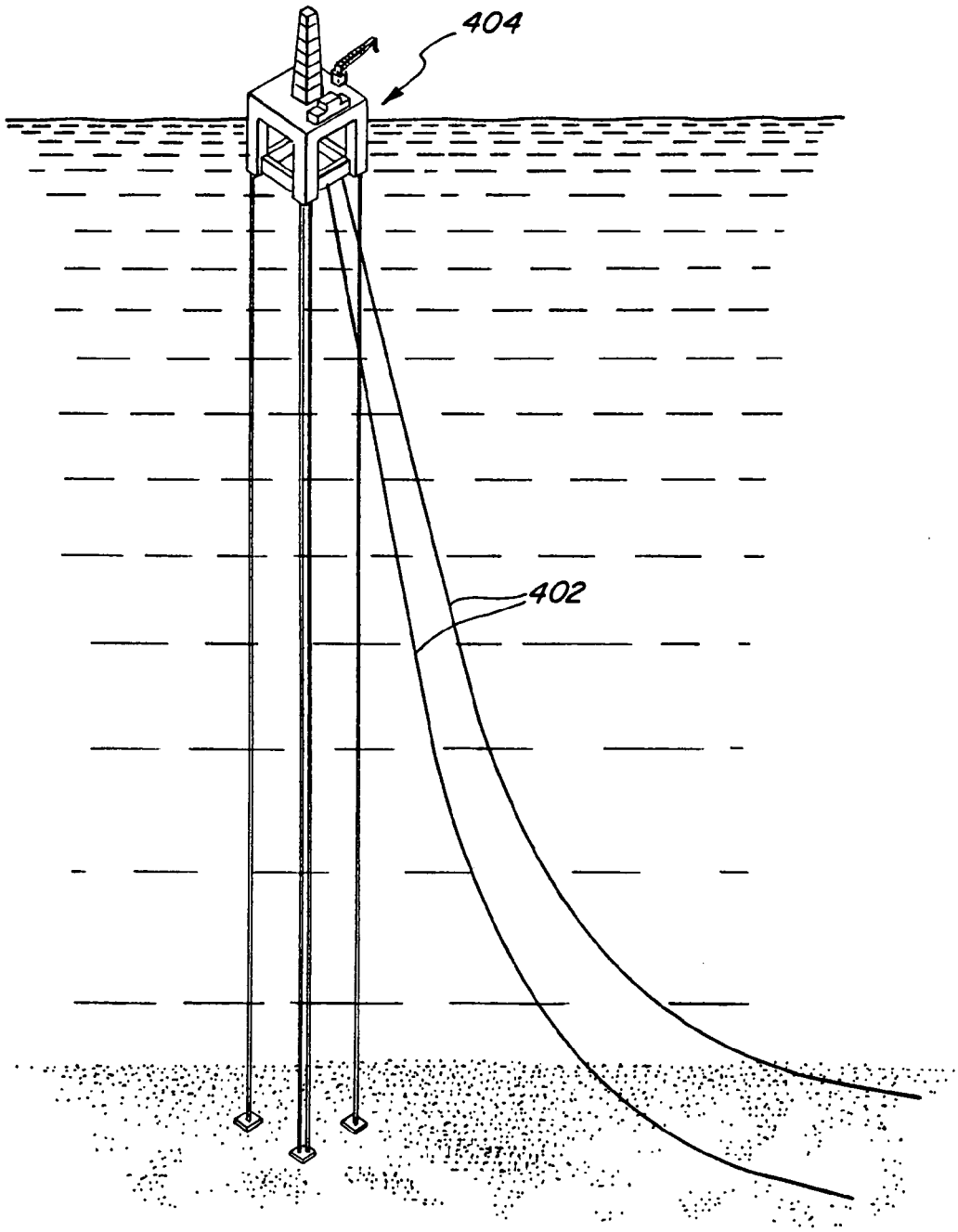
FIG. 4 PRIOR ART
FIG. 4 is an elevation view of an FPSO wet tree riser system in accordance with the prior art.
Figure 5:
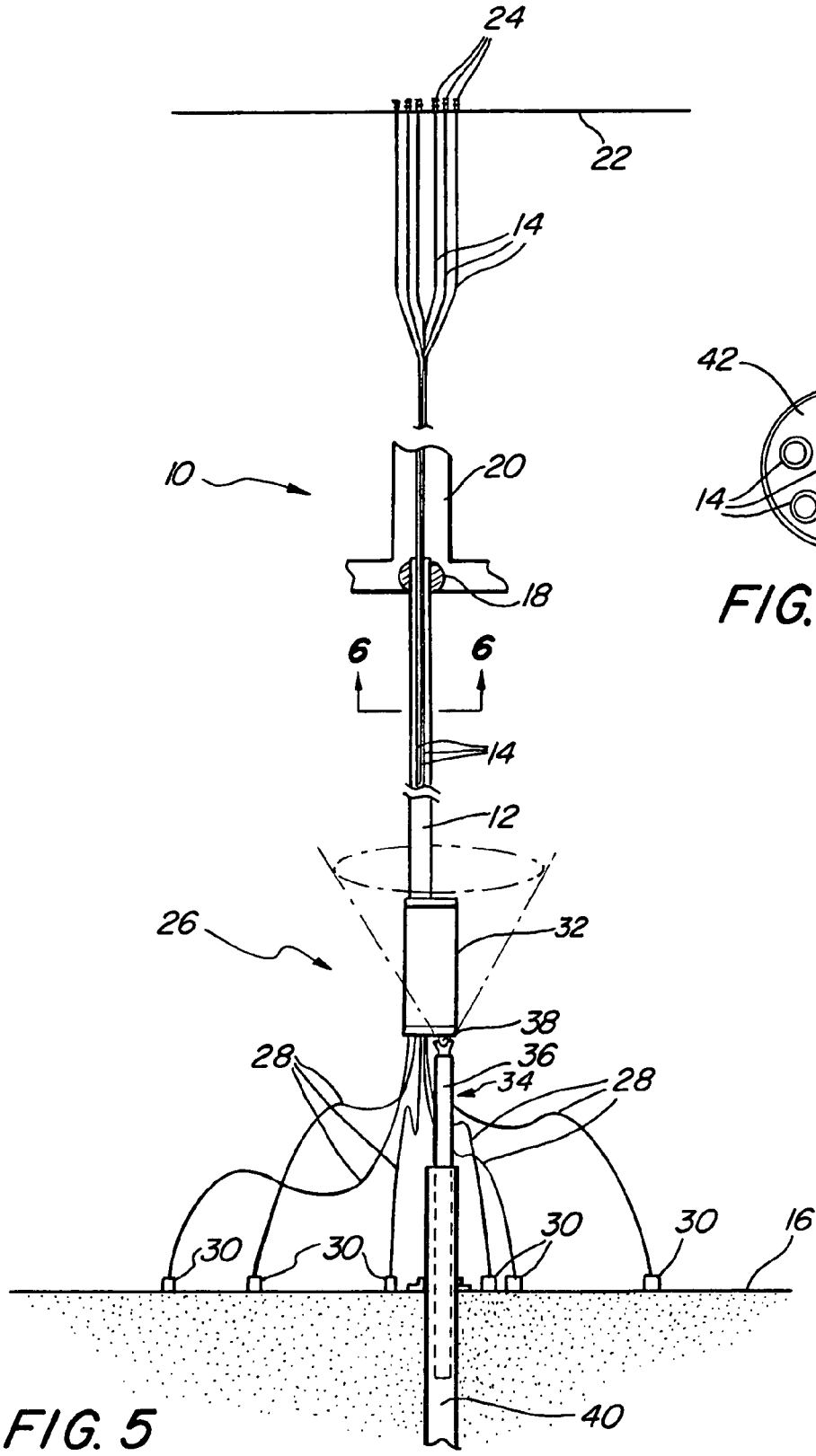
FIG. 5 is an elevation view of one exemplary embodiment of a bottom tensioned offshore oil well riser system in accordance with the present invention.

A first exemplary embodiment of a bottom tensioned offshore oil well riser system 10 in accordance with the present invention is illustrated in the elevation view of FIG. 5. The exemplary riser system illustrated comprises a tubular casing or conduit 12 enclosing a plurality of individual tubular riser pipes 14 suspended from a floating platform (omitted for clarity) and extending downward substantially vertically toward the sea floor 16 through a flexible joint 18 located at the keel 20 of the floating platform. Each of the individual riser pipes 14 extends upward to a well or production deck 22 of the platform, and is terminated thereat by an individual tree 24.

A bottom end connection and tensioning assembly 26 is attached to the bottom end of the conduit 12 at a distance of about 50 to 150 feet above the sea floor. The connection and tensioning assembly comprises jumpers 28 that connect the bottom end of each riser pipe to a respective sub-sea well equipment 30, a weight 32 for applying vertical tension in the conduit 12, and means 34 for constraining the bottom end of the conduit against horizontal movement while enabling it to move freely in a vertical direction and to pivot freely about its bottom end in response to motions of the floating platform.

In the first exemplary embodiment illustrated in FIG. 5, these constraining means 34 comprise a telescopic piling 36 that is connected to the bottom end of the conduit 12 through a ball-and-socket pivot joint 38 and slidably retained in a piling guide 40 that is sunk into the sea floor 16. The telescopic piling enables the conduit 12 to move up and down freely to accommodate the vertical motions of the floating platform, while preventing horizontal movement of its bottom end. This prevents the type of riser movement that can lead to high fatigue stresses in the associated jumpers 28. The pivot joint enables the conduit to pivot freely about its bottom end and thereby accommodate horizontal motions of the floating support while preventing large bending stresses in the conduit. The bottom end of the conduit is thus constrained to move in a small envelope relative to the seafloor, and thus, stresses in the jumpers are also reduced.

The jumpers 28 that connect the bottom end of each riser pipe 14 to a respective one of the sub-sea equipments 30, e.g., a well head, a sub-sea tree, a split tree, a manifold, a sea bed flow line, or the like, extend generally parallel to the sea floor 16, and to further reduce the stresses and fatigue loads acting thereon, are designed to be relatively flexible. For this purpose, interconnected recurvate pipe sections, flexible pipe jumpers, straight pipe sections connected with ball joints, or standard inverted U-spools can be used. Additionally, the jumpers can be configured to enable wire line, coiled tubing or "pigging" operations to be conducted through them, and if so, should incorporate radial bends having a radius of not less than about 5, and preferably, not less than about 10 times the outer diameter of the individual riser pipes.

The tensioning weight 32 may be arranged on either the bottom end of the casing 12 or the telescopic piling 36, and is used to impart vertical tension in the conduit and further stabilize its motions. In one advantageous embodiment, the tension imparted in the conduit by the weight is about 1.05 to 1.2 times the total weight of the conduit to efficiently control its movement and prevent vibrations due to waves and currents acting thereon. It may be seen that, since the conduit is pendant from the floating platform, the tensioning weight needs only provide the decimal part (i.e., about 0.05 to 0.2) of the desired tension. This is in distinct contrast to prior art top tensioned riser systems in which the buoyancy of the platform and/or buoyancy cans must be sufficient not only to support the weight of the conduit, but to provide the required tension in it, as well.

Figure 6:
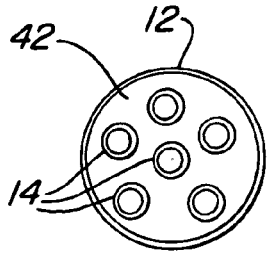
FIG. 6 is a cross-sectional view of the riser system of FIG. 5, as viewed along the section lines 6—6 therein.
Figure 8:
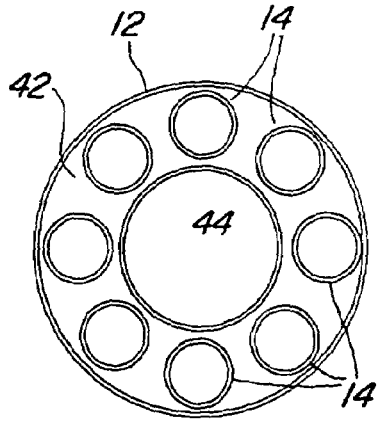
FIG. 8 is a cross-sectional view of the riser system of FIG. 7, as viewed along the section lines 8—8 therein.

In the particular embodiment illustrated in FIGS. 5 and 6, the riser system 10 comprises six individual tubular risers 14 arranged in a bundle and protectively enclosed within a larger outer casing 12. The outer casing provides a barrier to contain spillage in case of a breach in one of the individual risers, and additionally, the annular space 42 between the outer casing and the individual risers (see FIG. 8) can be used to facilitate production flow, e.g., to insulate the individual risers against cold sub-sea ambient temperatures, or alternatively, to heat them, such as by injection of steam or hot water into the annular space. Of course, the riser system can also comprise only a single pipe or pipe bundle, without an outer casing.

Figure 7:
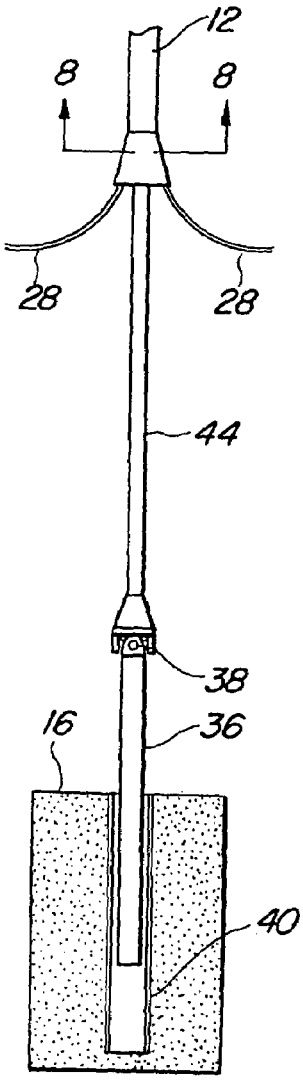
FIG. 7 is a partial elevation of a second exemplary embodiment of a bottom tensioned riser system in accordance with the present invention.

Alternative embodiments of bottom tensioned riser systems 10 are illustrated in FIGS. 7–10. The system illustrated in FIG. 7 is similar to that shown in FIG. 5, except that the conduit 12 includes a "centralizer," or core pipe 44 (see FIG. 8) the function of which is to withstand the tension loads in the riser pipes. This core pipe is extended downward from the bundle of the outer casing and individual riser pipes 14 and is pivotally connected to the telescopic piling 36 by means of a universal joint 38. In this embodiment, the telescopic piling also comprises the tensioning weight of the bottom end connection and tensioning assembly 26.

Figure 9:
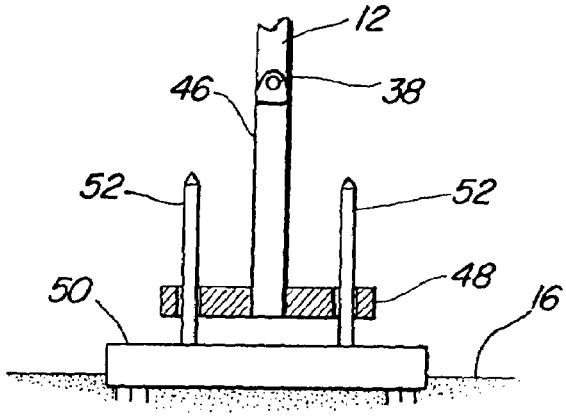
FIG. 9 is a partial elevation view of a third exemplary embodiment of a bottom tensioned riser system in accordance with the present invention.

In the embodiment illustrated in FIG. 9, the bottom end of the conduit 12 is pivotally connected to a plumb bar 46. The plumb bar has a base plate 48 containing a plurality of apertures at a lower end thereof. A guide base 50, which rests on the sea floor and is stabilized by its own weight, includes a plurality of upstanding guide posts 52, each of which is received in a corresponding one of the apertures in the base plate. The plumb bar, and hence, the bottom end of the conduit, are thereby constrained to move only vertically in response to movements of the floating platform, and the bottom tension in the conduit is supplied by the weight of the plumb bar.

Figure 10:
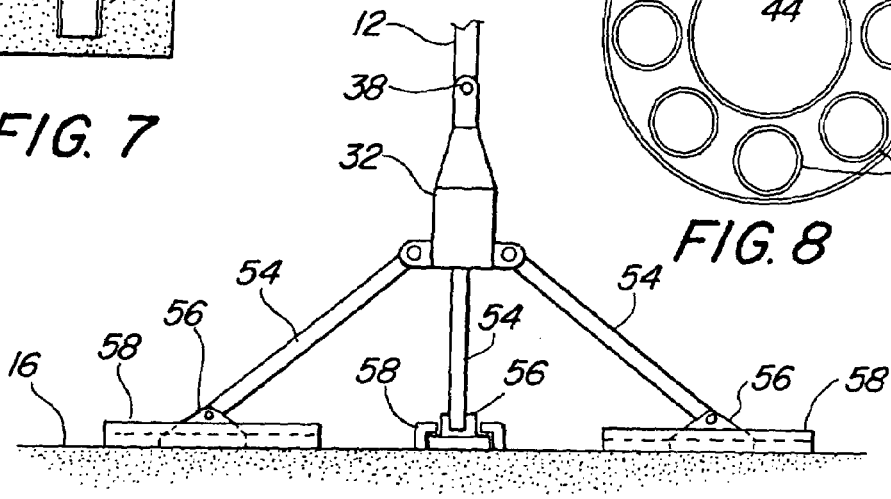
FIG. 10 a partial elevation view of a fourth exemplary embodiment of a bottom tensioned riser system in accordance with the present invention.

In the embodiment illustrated in FIG. 10, the riser conduit 12 is connected by a pivot joint 38 to a tensioning weight 32. The tensioning weight, in turn, is pivotally attached to the upper ends of three rigid arms 54. The lower ends of the arms are each pivotally attached to a respective shoe 56 that is constrained to slide horizontally within a respective horizontal guide rail 58 attached to the sea floor 16. This arrangement, like those of the other embodiments, constrains the bottom end of the conduit against horizontal movement, while enabling it to move freely in a vertical direction and to pivot freely about its bottom end in response to motions of the floating platform.

Figure 11:
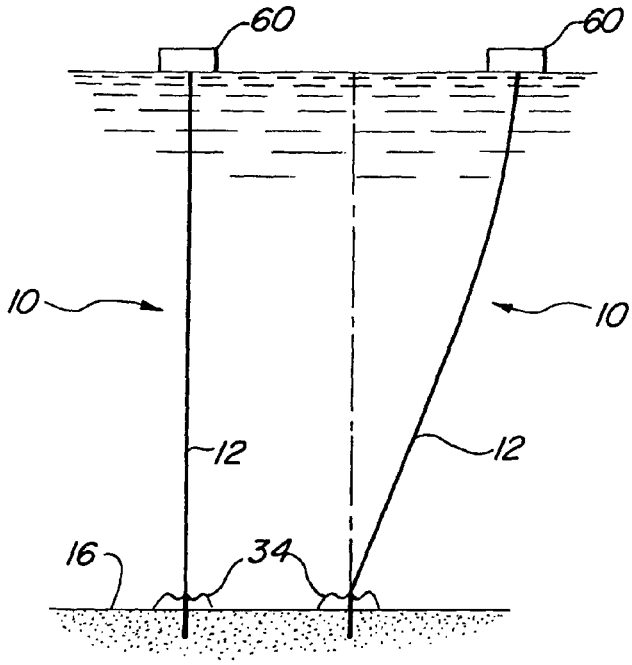
FIG. 11 is an elevation view of a bottom tensioned riser system in accordance with the present invention, showing the configuration of the system before and after movement of an associated floating platform.
Figure 12:
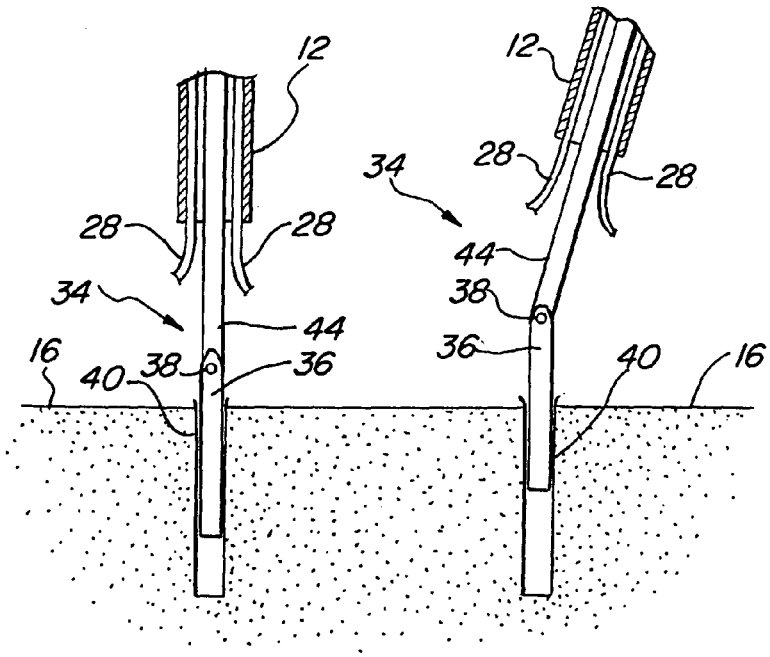
FIG. 12 is an enlarged partial elevation view of the riser system of FIG. 11, showing the configuration of the bottom end of the system before and after the platform movement.

FIG. 11 illustrates the configuration of the bottom tensioned riser system 10 of the present invention before and after movement of an associated floating platform 60, respectively. An enlarged partial elevation view of the riser system of FIG. 11 is illustrated in FIG. 12, showing the combination of the vertical stroke and pivoting movement of the bottom end of the riser system to accommodate the surface movement of the floating platform.

The bottom tensioned riser system 10 of the present invention is applicable to a wide variety of installations. Indeed, a wide range of production and service riser types can be used to connect the sub-sea equipment to the floating platform, including single pipe, pipe-in-pipe, piping bundles (i.e., with or without an outer casing and with or without a core pipe), insulated or not. The riser system can also include service lines, umbilicals, injection lines, gas lift lines, active heating lines and monitoring lines of a type that are known to those of skill in the art. Also, the riser system can be deployed in surface or sub-sea completion systems or combinations thereof, e.g., with dry trees, wet trees or so-called "split trees."

The many advantages of the novel riser system include that no expensive buoyancy cans are required, since the floating platform provides inexpensive buoyancy to support the system. Since less tension is required in the riser, less stress is applied to it. The bottom end tensioning weight needs to provide only a fractional part of the required tension in the system, and since a tensioning weight cannot be accidentally flooded, the system is safer than those using buoyancy cans. Riser pipe bundle configurations effectively prevent collisions between adjacent risers and reduce the total amount of riser tension needed. Bundle configurations also provide a weight advantage, since only one outer casing is required to protect a plurality of individual riser pipes. As the riser system comprises steel pipe, it is also cost effective, and since the system is substantially vertical, the total length of riser pipe needed is reduced. The system provides direct connection to the floating platform, and can provide direct access to the well, as in conventional dry tree, top tensioned riser systems. Since there is no relative motion between the riser and the floating platform, rigid pipe can be used to connect the riser system to the process deck. The foregoing advantages make ultra deepwater riser development feasible.

As will be apparent by now to those of skill in the art, many modifications, alterations and substitutions are possible to the materials, methods and configurations of the riser systems of the present invention without departing from its spirit and scope. Accordingly, the scope of the present invention should not be limited to that of the particular embodiments described and illustrated herein, as these are merely exemplary in nature. Rather, the scope of the present invention should be commensurate with that of the claims appended hereafter, and their functional equivalents.

What is claimed is:

1. A bottom tensioned riser system for conveying petroleum from an offshore oil well on a sea floor to a platform floating above, the riser system comprising:

a tubular conduit comprising a plurality of individual tubular riser pipes, the conduit being suspended from the platform and having a bottom end extending downward therefrom in a substantially vertical direction and toward the sea floor; and, a connection and tensioning assembly disposed at die bottom end of the conduit, the connection and tensioning assembly comprising:

a flexible jumper connecting the bottom end of the conduit to the well;

a weight applying a vertical tension in the conduit; and a telescopic piling connected to the bottom end of the conduit by a pivot joint and slidably retained in a piling guide sunk into the sea floor, thereby constraining the bottom end of the conduit against horizontal movement, while enabling the conduit to move freely in a vertical direction and to pivot freely about the bottom end thereof in response to motions of the platform.

2. The riser system of claim 1, wherein the plurality of individual riser pipes are disposed within a single larger casing.

3. The riser system of claim 2, further comprising a core pipe surrounded by the plurality of individual riser pipes.

4. The riser system of claim 1, wherein the weight is disposed on the conduit at the bottom end thereof.

5. The riser system of claim 1, wherein the weight is disposed in the telescopic piling.

6. The riser system of claim 1, wherein the vertical tension in the conduit is between about 1.05 to 1.2 times the weight of the conduit.

7. A bottom tensioned riser system for conveying petroleum from an offshore oil well on a sea floor to a platform floating above, the riser system comprising:

a tubular conduit comprising a plurality of individual tubular riser pipes, the conduit being suspended from the platform and having a bottom end extending downward therefrom in a substantially vertical direction and toward the sea floor; and a connection and tensioning assembly disposed at the bottom end of the conduit, the connection and tensioning assembly comprising:

a flexible jumper connecting the bottom end of the conduit to the well;

a weight applying a vertical tension in the conduit; and constraining means for constraining the bottom end of the conduit against horizontal movement, while enabling the conduit to move freely in a vertical direction and to pivot freely about the bottom end thereof in response to motions of the platform;

wherein the constraining means comprises:

a plumb bar pivotally connected to the bottom end of the conduit and having a lower end with a base plate mounted thereon, the base plate containing a plurality of apertures; and a guide base disposed on the sea floor and having a plurality of upstanding guide posts, each guide post being slidably received in a corresponding one of the apertures in the base plate.

8. A bottom tensioned riser system for conveying petroleum from an offshore oil well on a sea floor to a platform floating above, the riser system comprising:

a tubular conduit comprising a plurality of individual tubular riser pipes, the conduit being suspended from the platform and having a bottom end extending downward therefrom in a substantially vertical direction and toward the sea floor; and a connection and tensioning assembly disposed at the bottom end of the conduit, the connection and tensioning assembly comprising:

a flexible jumper connecting the bottom end of the conduit to the well;

a weight applying a vertical tension in the conduit; and constraining means for constraining the bottom end of the conduit against horizontal movement, while enabling the conduit to move freely in a vertical direction and to pivot freely about the bottom end thereof in response to motions of the platform;

wherein the constraining means comprises:

the weight being connected to the bottom end of the conduit by a pivoting joint; three guide rails attached to the sea floor; and three rigid arms, each having an upper end pivotally attached to the weight and a lower end pivotally attached to a respective shoe, and wherein each of the shoes is retained in a corresponding one of the guide rails for horizontal movement.

9. The riser system of claim 1, wherein the jumper comprises steel or a flexible elastomer.

10. The riser system of claim 1, wherein the jumper includes a radial bend, and wherein the bend has a radius of about 5–10 times the diameter of the conduit.

11. A bottom-tensioned riser system for conveying petroleum from an offshore oil well on a sea floor to a platform floating above, the riser system comprising:

a tubular conduit suspended from the platform and having a bottom end extending downward therefrom in a substantially vertical direction and toward the sea floor;

a flexible jumper connecting the bottom end of the conduit to the well; and a connection and tensioning assembly disposed at the bottom end of the conduit, the connection and tensioning assembly comprising:

a weight connected to the bottom of the conduit and applying a vertical tension in the conduit; and a telescopic piling connected to the bottom end of the conduit by a pivot joint and slidably retained in a piling guide sunk into the sea floor, thereby constraining the bottom end of the conduit against horizontal movement, while enabling the conduit to move freely in a vertical direction and to pivot freely about the bottom end thereof in response to motions of the platform.

12. The riser system of claim 11, wherein the weight is disposed in the telescopic piling.

13. The riser system of claim 11, wherein the vertical tension in the conduit is between about 1.05 to 1.2 times the weight of the conduit.

14. A bottom-tensioned riser system for conveying petroleum from an offshore oil well on a sea floor to a platform floating above, the riser system comprising:

a tubular conduit suspended from the platform and having a bottom end extending downward therefrom in a substantially vertical direction and toward the sea floor;

a flexible jumper connecting the bottom end of the conduit to the well; and a connection and tensioning assembly disposed at the bottom end of the conduit, the connection and tensioning assembly comprising:

a weight connected to the bottom of the conduit and applying a vertical tension in the conduit; and means for constraining the bottom end of the conduit against horizontal movement, while enabling the conduit to move freely in a vertical direction and to pivot freely about the bottom end thereof in response to motions of the platform;

wherein the means for constraining comprises:

a plumb bar pivotally connected to the bottom end of the conduit and having a lower end with a base plate mounted thereon, the base plate containing a plurality of apertures; and a guide base disposed on the sea floor and having a plurality of upstanding guide posts, each guide post being slidably received in a corresponding one of the apertures in the base plate.

15. A bottom-tensioned riser system for conveying petroleum from an offshore oil well on a sea floor to a platform floating above, the riser system comprising:

a tubular conduit suspended from the platform and having a bottom end extending downward therefrom in a substantially vertical direction and toward the sea floor;

a flexible jumper connecting the bottom end of the conduit to the well; and a connection and tensioning assembly disposed at the bottom end of the conduit, the connection and tensioning assembly comprising:

a weight connected to the bottom of the conduit and applying a vertical tension in the conduit; and means for constraining the bottom end of the conduit against horizontal movement, while enabling the conduit to move freely in a vertical direction and to pivot freely about the bottom end thereof in response to motions of the platform;

wherein the means for constraining comprises:

a pivoting joint connecting the weight to the bottom end of the conduit;

a plurality of guide rails attached to the sea floor;

a shoe slidably received on each of the guide rails for horizontal movement thereon; and a plurality of arms, each having an upper end pivotally attached to the weight and a lower end pivotally attached to a respective shoe.

* * * * *

UNITED STATES PATENT AND TRADEMARK OFFICE

CERTIFICATE OF CORRECTION

PATENT NO. : 7,063,158 B2
APPLICATION NO. : 10/626488
DATED : June 20, 2006
INVENTOR(S) : Edward E. Horton, III It is certified that error appears in the above-identified patent and that said Letters Patent is hereby corrected as shown below:

- The word "die" at column 7, line 51 should read as --the--.

Signed and Sealed this

Twenty-eighth Day of November, 2006

JON W. DUDAS
*Director of the United States Patent and Trademark Office*